US005408073A

United States Patent [19]

Jeong

[11] Patent Number: 5,408,073

[45] Date of Patent: Apr. 18, 1995

[54] OVERHEAT PREVENTION CIRCUIT FOR ELECTROMAGNETIC INDUCTION HEATING COOKER

[75] Inventor: Young-Chul Jeong, Suwon, Rep. of Korea

[73] Assignee: Samsung Electronics Co., Ltd., Suwon, Rep. of Korea

[21] Appl. No.: 199,735

[22] Filed: Feb. 22, 1994

[30] Foreign Application Priority Data

Feb. 20, 1993 [KR] Rep. of Korea ..... 93-2368

[51] Int. Cl.[6] ..... H05B 6/06

[52] U.S. Cl. ..... 219/623; 219/627; 219/667; 219/494

[58] Field of Search ..... 219/623, 627, 632, 667, 219/494, 506

[56] References Cited

U.S. PATENT DOCUMENTS

| | | | |
|---|---|---|---|
| 3,710,062 | 1/1973 | Peters, Jr. | 219/627 |
| 3,804,968 | 4/1974 | Mosser | 219/667 |
| 4,191,875 | 3/1980 | Cunningham | 219/623 |
| 4,638,135 | 1/1987 | Aoki | 219/627 |

FOREIGN PATENT DOCUMENTS 61-230288 10/1986 Japan .

*Primary Examiner*—Philip H. Leung

*Attorney, Agent, or Firm*—Burns, Doane, Swecker & Mathis

[57] ABSTRACT

An overheat prevention circuit for an electromagnetic induction heating cooker. The electromagnetic induction heating cooker has a heating coil, a top plate disposed over the heating coil, on which an object to be heated is laid, a temperature sensing part for sensing a temperature of the object and a high-frequency power generation part for generating a high-frequency magnetic field to the heating coil to induction-heat the object. The overheat prevention circuit comprises a temperature sense processing circuit for sensing the temperature of the object and outputting a signal as a result of the sensing, a power block processing circuit for blocking power supply to the high-frequency power generation part when an internal temperature of the cooker exceeds a predetermined reference value and outputting a signal as a result of the blocking, and a control unit for discriminating an overheated state of the cooker in response to the output, signals from the temperature sense processing circuit and power block processing circuit and, in accordance with the discriminated result, controlling an operation of the high-frequency power generation part, outputting a cooling fan drive signal to cool the cooker and outputting a control signal to inform the user of the overheated state of the cooker.

14 Claims, 2 Drawing Sheets

OVERHEAT PREVENTION CIRCUIT FOR ELECTROMAGNETIC INDUCTION HEATING COOKER

BACKGROUND OF THE INVENTION

1. Field of the Invention

The present invention relates in general to electromagnetic induction heating cookers, and more particularly to an overheat prevention circuit for an electromagnetic induction heating cooker which is capable of preventing a fire or a burn resulting from overheating of a top plate which may be generated due to a fault of the user or a malfunction of the appliance itself.

2. Description of the Prior Art

Generally, an electromagnetic induction heating cooker comprises a top plate disposed over a heating coil, on which an object (i.e., a cooking container) to be heated is laid, temperature sensing means for sensing a temperature of the object, high-frequency power generation means for generating a high-frequency magnetic field to the heating coil to induction-heat the object, and control means for controlling the high-frequency power generation means in accordance with the temperature of the object sensed by the temperature sensing means.

As the electromagnetic induction heating cooker is operated under the control of the user, the object laid on the top plate is heated. At this time, the temperature sensing means senses the temperature of the heated object through the top plate on which the object is laid. The sensed temperature from the temperature sensing means is applied to the control means. If the sensed temperature is greater than or equal to a predetermined reference value, the control means stops the operation of the high-frequency power generation means.

One example of such an electromagnetic induction heating cooker is disclosed in Japanese Patent Laid-open Publication No. Sho 61-230288 entitled "INDUCTION HEATING COOKER", and is shown in FIG. 2, herein.

In the electromagnetic induction heating cooker of the above patent, as shown in FIG. 2, an object. (cooking container) 3 to be heated is laid on a top plate 2 disposed in a cooking base body 1, and is induction-heated by a high-frequency magnetic field. A temperature sensor 4 acts to sense a temperature of the object 3 on the top plate 2.

The conventional electromagnetic induction heating cooker in FIG. 2 is adapted to prevent a fire and the like which may take place as an actual temperature of the heated object 3 becomes higher than the temperature sensed by the temperature sensor 4 at an initial state of the heating. To this end, the conventional electromagnetic induction heating cooker in FIG. 2 comprises temperature over-rise prevention means for stopping the heating operation if the temperature sensed by the temperature sensor 4 reaches a predetermined reference value, and control means for reducing the heating output for a predetermined time period at the initial state of the heating.

In FIG. 2, the temperature over-rise prevention means and the control means are provided on a control circuit board 8. The reference numerals 5, 6, 7 and 9, not described, designate a heating coil, an inverter circuit, a power transformer and a cooling fan, respectively.

The above-mentioned conventional electromagnetic induction heating cooker has the effect of preventing overheating, more particularly the occurrence of the fire at the initial state of the heating operation. However, the conventional electromagnetic induction heating cooker has a disadvantage in that a fire or a burn may take place due to overheating of the top plate resulting from a malfunction of a component in the appliance such as the temperature sensor. Also, the electromagnetic induction heating cooker cannot be used as long as the reliability of the associated circuitry is not 100% assured on the basis of a control circuit failure mode effect analysis (FMEA) of an UL standard about safety, which has recently been enforced in U.S.A.

SUMMARY OF THE INVENTION

Therefore, the present invention has been made in view of the above problem, and it is an object of the present invention to provide an overheat prevention circuit for an electromagnetic induction heating cooker in which in the case where an object is overheated exceeding a first predetermined reference temperature, a top plate is cooled and then a heating operation is again performed, and in the case where an internal temperature of the electromagnetic induction heating cooker exceeds a second predetermined reference temperature because of a malfunction of a component in the appliance such as a temperature sensor, the heating operation is completely blocked and at the same time a cooling fan is continuously actuated to rapidly cool the electromagnetic induction heating cooker.

In accordance with the present invention, in an electromagnetic induction heating cooker which has a heating coil, a top plate disposed over said heating coil on which an object to be heated is laid, temperature sensing means for sensing a temperature of the object and high-frequency power generation means for generating a high-frequency magnetic field to said heating coil to induction-heat the object, there is provided a circuit for preventing overheating of the electromagnetic induction heating cooker, comprising temperature sense processing means for sensing the temperature of the object and outputting a signal as a result of the sensing; power block processing means for blocking power supply to said high-frequency power generation means when an internal temperature of the electromagnetic induction heating cooker exceeds a predetermined reference value, and outputting a signal as a result of the blocking; and control means for discriminating an overheated state of the electromagnetic induction heating cooker in response to the output signals from said temperature sense processing means and power block processing means and, in accordance with the discriminated result, controlling an operation of said high-frequency power generation means, outputting a cooling fan drive signal to cool the electromagnetic induction heating cooker and outputting a control signal to inform the user of the overheated state of the electromagnetic induction heating cooker.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
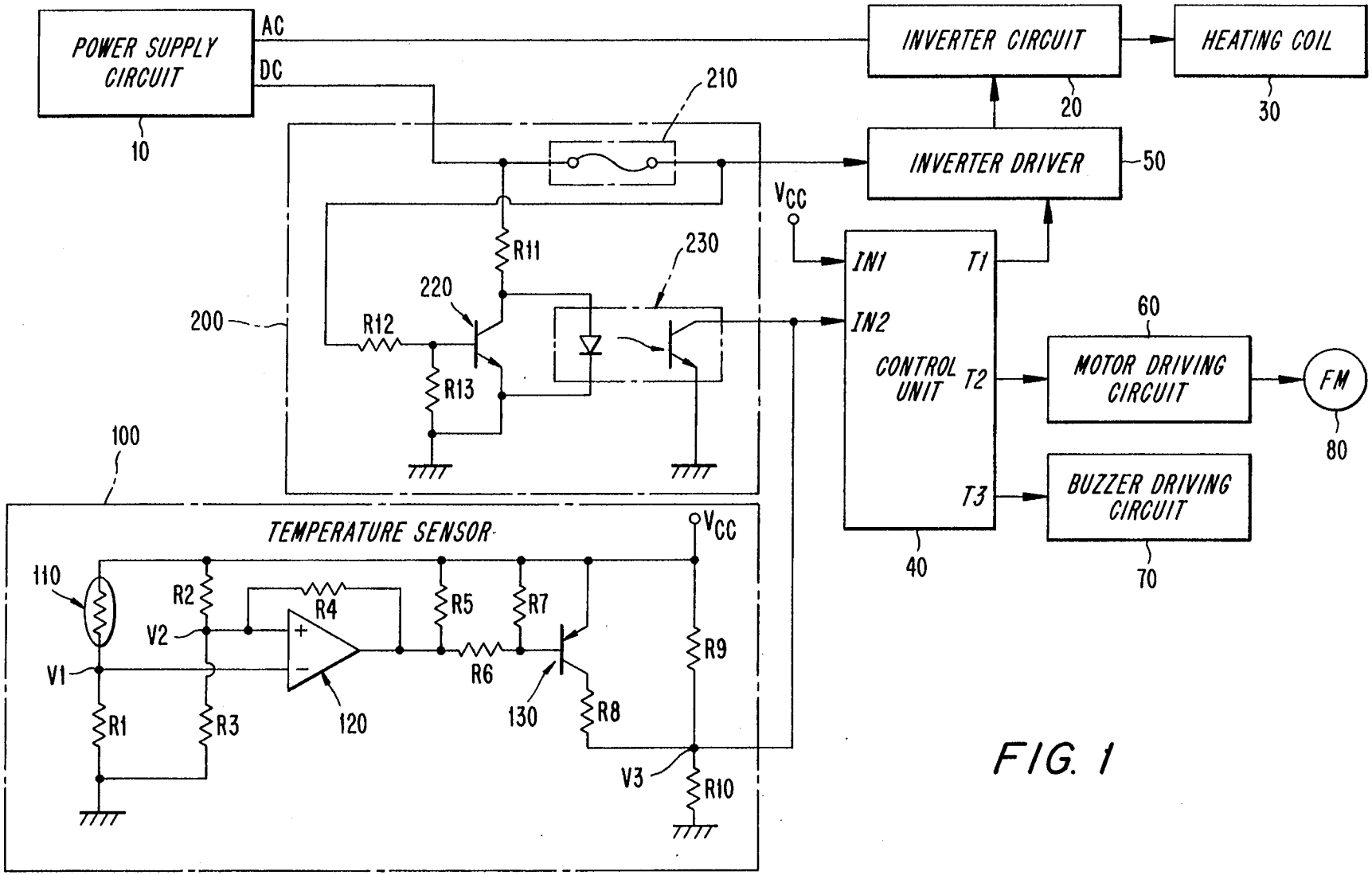
FIG. 1 is a circuit diagram of an overheat prevention circuit for an electromagnetic induction heating cooker in accordance with an embodiment of the present invention.
Figure 2:
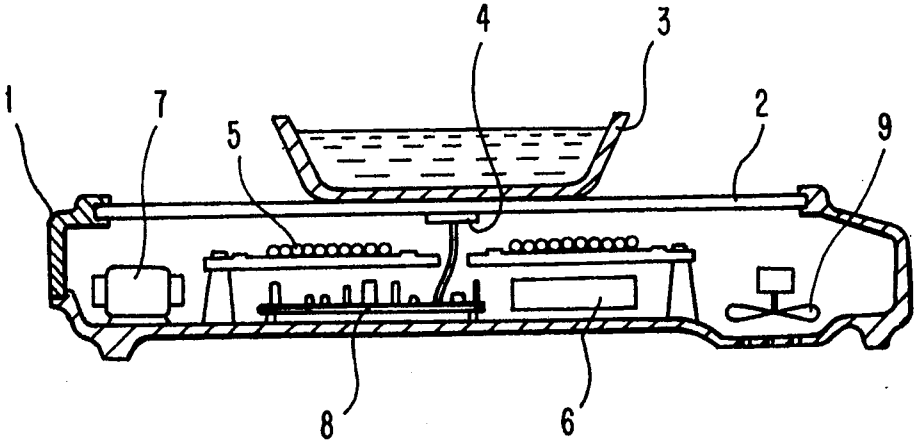
FIG. 2 (PRIOR ART)
FIG. 2 is a sectional view of a conventional electromagnetic induction heating cooker.

Referring to FIG. 1, there is shown a circuit diagram of an overheat prevention circuit for an electromagnetic induction heating cooker in accordance with an embodiment of the present invention. As shown in this drawing, a power supply circuit 10 is provided to input an external power and supply an alternating current (AC) voltage (110 V or 220 V) and a direct current (DC) voltage (5 V or/and 12 V).

A control unit 40 is adapted to control the entire operation of the electromagnetic induction heating cooker in response to user's commands from a plurality of switches, not shown.

An inverter driver 50 is operated under the control of the control unit 40 to convert the DC voltage from the power supply circuit 10 into a drive signal of a frequency of 20–40 KHz.

An inverter circuit 20 is operated responsive to the drive signal from the inverter driver 50 to apply the AC voltage from the power supply circuit 10 to a heating coil 30. The inverter circuit 20 has a plurality of switching devices, not shown.

The inverter driver 50 and the inverter circuit 20 constitutes high-frequency power generation means.

Although not shown, a top plate is disposed over the heating coil 30, on which an object (cooking container) to be heated is laid.

A temperature sense processing circuit 100 is provided to sense the temperature of the object through the top plate and output a signal as a result of the sensing.

A power block processing circuit 200 is adapted to block the AC and DC voltages from the power supply circuit 10 to the high-frequency power generation means when an internal temperature of the electromagnetic induction heating cooker exceeds a predetermined reference value, and output a signal as a result of the blocking.

A motor driving circuit 60 is operated under the control of the control unit 40 to drive a cooling fan motor 80, so as to cool the electromagnetic induction heating cooker.

A buzzer driving circuit 70 is operated under the control of the control unit 40 to drive a buzzer, so as to inform the user of an overheated state of the electromagnetic induction heating cooker.

The temperature sense processing circuit 100 includes a thermistor 110 having a resistance varied with the temperature of the object, a comparator 120 for comparing a voltage level. V1 varied by the thermistor 110 with a reference voltage level V2, and a transistor 120 being turned on/off in response to an output signal from the comparator 130.

The thermistor 110 has a negative resistance characteristic. Namely, the resistance of the thermistor 110 is reduced as the temperature rises and is increased as the temperature falls.

The power block processing circuit 200 includes a thermal fuse 210 which is opened when the internal temperature of the electromagnetic induction heating cooker exceeds the predetermined reference value, a transistor 220 which is turned on/off in response to closed/opened states of the thermal fuse 210, and a photocoupler 230 which is turned on/off in response to a switching operation of the transistor 220.

The operation of the overheat prevention circuit for the electromagnetic induction heating cooker with the above-mentioned construction in accordance with the embodiment of the present invention will hereinafter be described in detail.

First, when the user pushes desired function keys (not shown) to operate the electromagnetic induction heating cooker, the AC voltage from the power supply circuit 10 is supplied through the inverter circuit 20 to the heating coil 30 and to the cooling fan motor 80. Also, the DC voltage from the power supply circuit 10 is supplied to the temperature sense processing circuit 100, the power block processing circuit 200 and a terminal IN1 of the control unit 40.

The DC voltage from the power supply circuit 10 is also supplied to the inverter driver 50 through the thermal fuse 210 of the power block processing circuit 200.

In a normal state, the thermal fuse 210 Of the power block processing circuit 200 remains at its closed state. Hence, the DC voltage from the power supply circuit 10 is supplied to the inverter driver 50 through the closed thermal fuse 210 of the power block processing circuit 200. Also in the power block processing circuit 200, the DC voltage from the power supply circuit 10 is directly applied to a collector of the transistor 220 and through the thermal fuse 210 to a base of the transistor 220. As a result, the transistor 220 is turned on, thereby causing the photocoupler 230 to be turned off.

Also in the normal state, the temperature of the object sensed through the top plate is below a predetermined reference value and the resistance Rt of the thermistor 110 in the temperature sense processing circuit 100 is thus increased.

In the temperature sense processing circuit 100, the voltage level V1 divided by the resistance Rt of the thermistor 110 and a resistor R1 becomes lower than the reference voltage level V2 divided by resistors R2 and R3 as the resistance Rt of the thermistor 110 is increased. In this case, a high level signal from the comparator 120 is applied to a base of the transistor 130, thereby causing the transistor 130 to be turned off.

With the transistor 130 turned off, a voltage V3 divided by resistors R9 and R10 is outputted from the temperature sense processing circuit 100. The divided voltage V3 from the temperature sense processing circuit 100 is applied to a terminal IN2 of the control unit 40 because of the OFF state of the photocoupler 230 in the power block processing circuit 200.

At this time, the divided voltage V3 from the temperature sense processing circuit 100 has a predetermined level L1, referred to hereinafter as a "first level". Upon receiving the divided voltage V3 of the first level L1 from the temperature sense processing circuit 100, the control unit 40 determines that the internal temperature of the electromagnetic induction heating cooker and the temperature of the object sensed through the top plate are normal. As a result, the control unit 40 outputs an operation start signal to the inverter driver 50 through its terminal T1.

Upon receiving the operation start signal from the control unit 40, the inverter driver 50 outputs the drive signal of the frequency of 20–40 KHz to the inverter circuit 20. Then, the inverter circuit 20 drives the heating coil 30 in response to the drive signal from the inverter driver 50.

As the heating coil 30 is driven, the object on the top plate is heated and the cooking is thus performed. Also, the temperature of the top plate rises.

The resistance Rt of the thermistor 110 is reduced as the temperature of the top plate rises, thereby causing the level of the voltage V3 from the temperature sense processing circuit 100 to become lower.

Thereafter, when the temperature of the top plate exceeds a predetermined reference value t1 (about 320° C. as an overheat temperature) due to its continuous rise, the resistance Rt of the thermistor 110 is reduced still more. As a result, the voltage level V1 divided by the resistance Rt of the thermistor 110 and the resistor R1 becomes higher than the reference voltage level V2 divided by the resistors R2 and R3.

If the divided voltage level V1 is higher than the reference voltage level V2, a low level signal from the comparator 120 is applied to the base of the transistor 130, thereby causing the transistor 130 to be turned on. In this case, the voltage V3, divided by a combined resistance of a resistor R8 and the resistor R9 and a resistance of the resistor R10 is output from the temperature sense processing circuit 100. The divided voltage V3 from the temperature sense processing circuit 100 is applied to the terminal IN2 of the control unit 40 because of the OFF state of the photocoupler 230 in the power block processing circuit 200.

At this time, the divided voltage V3 from the temperature sense processing circuit 100 has a predetermined level L2, referred to hereinafter as a "second level".

In the temperature sense processing circuit 100, the resistance of the resistor R8 is smaller than that of the resistor R9, namely, R8<R9, and the first level L1 is higher than the second level L2, namely, L1>L2.

Upon receiving the divided voltage V3 of the second level L2 from the temperature sense processing circuit 100, the control unit 40 determines that the internal temperature of the electromagnetic induction heating cooker is normal, whereas the object is at its overheated state. As a result of the determination, the control unit 40 outputs an operation stop signal to the inverter driver 50 through its terminal T1.

The inverter driver 50 stops the output of the drive signal to the inverter circuit 20 in response to the operation stop signal from the control unit 40. Then, upon receiving no drive signal from the inverter driver 50, the operation of the inverter circuit 20 is stopped and the driving of the heating coil 30 is thus stopped.

Also in response to the divided voltage V3 of the second level L2 from the temperature sense processing circuit 100, the control unit 40 outputs a fan drive signal to the motor driving circuit 60 through its terminal T2 to allow the motor driving circuit 60 to drive the cooling fan motor 80. As a result, the electromagnetic induction heating cooker (or the top plate) is cooled by a cooling fan (not shown) which is rotated by the driven cooling fan motor 80.

Thereafter, if the temperature of the top plate reaches a predetermined reference value t2 (about 200° C. as a normal temperature) due to its continuous cooling depending on the driving of the cooling fan motor 80, the level of the divided voltage V3 from the temperature sense processing circuit 100 becomes higher than the second level L2.

At the time that the level of the output voltage V3 from the temperature sense processing circuit 100 becomes higher than the second level L2, the control unit 40 stops the output of the fan drive signal to the fan driving circuit 60, so as to stop the driving of the cooling fan motor 80.

Thereafter, when the electromagnetic induction heating cooker is again set by the user, the control unit 40 determines that the internal temperature of the electromagnetic induction heating cooker and the temperature of the object are normal and then outputs the operation start signal to the inverter driver 50 through its terminal T1.

Hence, as mentioned previously, the inverter circuit 20 drives the heating coil 30 in response to the drive signal from the inverter driver 50. As the heating coil 30 is driven, the object on the top plate is heated and the cooking is thus performed.

On the other hand, in the case where the internal temperature of the electromagnetic induction heating cooker exceeds a predetermined reference value (about 130° C.) in operation due to a fault of the user or a malfunction of a component in the appliance such as the temperature sense processing circuit 100, the thermal fuse 210 of the power block processing circuit 200 is opened.

The opened state of the thermal fuse 210 stops the operation of the inverter driver 50, resulting in the output of no drive signal. As a result, the operation of the inverter circuit 20 is stopped and the driving of the heating coil 30 is thus stopped.

Also in the power block processing circuit 200, the opened state of the thermal fuse 210 causes the transistor 220 to be turned off and the photocoupler 230 to be turned on. With the photocoupler 230 turned on, a low level signal (ground) is applied to the terminal IN2 of the control unit 40.

Upon receiving the low level signal through the terminal IN2, the control unit 40 determines that a fire may take place due to the overheating of the electromagnetic induction heating cooker or the malfunction present in the appliance, and then outputs the fan drive signal through its terminal T2 and a buzzer drive signal through its terminal T3, respectively.

Subsequently, the cooling fan motor 80 is driven by the motor driving circuit 60 to cool the electromagnetic induction heating cooker and the buzzer is driven by the buzzer driving circuit 70 to inform the user of the overheated state of the electromagnetic induction heating cooker. In this case, the control unit 40 continues to output the fan drive signal through its terminal T2 to drive the cooling fan motor 80 until the user pulls out the plug of the electromagnetic induction heating cooker.

As apparent from the above description, according to the present invention, in the case where the top plate is overheated, it is cooled by the cooling fan and then the heating operation is again performed. Also, in the case where the fire may take place due to the overheating of the electromagnetic induction heating cooker or a malfunction present in the appliance, the heating operation is completely blocked and at the same time the cooling fan is continuously actuated to rapidly cool the electromagnetic induction heating cooker. Therefore, burning of the user as well as the fire can be avoided.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. In particular, the temperature sense processing circuit and the power block processing circuit may simply be modified within the scope and spirit of the invention.

What is claimed is:

1. In electromagnetic induction heating cooker which has a heating coil, a top plate disposed over said heating coil on which an object to be heated is laid, temperature sensing means for sensing a temperature of the object and high-frequency power generation means for generating a high-frequency magnetic field to said heating coil to induction-heat the object, a circuit for preventing overheating of the electromagnetic induction heating cooker, comprising:

temperature sense processing means for sensing the temperature of the object and outputting a signal as a result of the sensing;

power block processing means for blocking a power supply to said high-frequency power generation means when an internal temperature of the electromagnetic induction heating cooker exceeds a predetermined reference value, and outputting a signal as a result of the blocking; and control means for discriminating an overheated state of the electromagnetic induction heating cooker in response to the output signals from said temperature sense processing means and power block processing means and, in accordance with the discriminated state, controlling an operation of said high-frequency power generation means, outputting a cooling fan drive signal to cool the electromagnetic induction heating cooker and outputting a control signal to inform the user of the overheated state of the electromagnetic induction heating cooker.

2. A circuit for preventing overheating of an electromagnetic induction heating cooker as set forth in claim 1, wherein said temperature sense processing means includes:

a temperature sensor having a resistance varied with the temperature of the object;

comparison means for comparing a voltage level varied by said temperature sensor with a reference voltage level; and switching means being turned on/off in response to an output signal from said comparison means.

3. A circuit for preventing overheating of an electromagnetic induction heating cooker as set forth in claim 1, wherein said power block processing means includes:

a thermal fuse being opened when the internal temperature of the electromagnetic induction heating cooker exceeds the predetermined reference value; and switching means being turned on/off in response to closed/opened states of said thermal fuse.

4. A circuit for preventing overheating of an electromagnetic induction heating cooker as set forth in claim 1, wherein said control means discriminates the internal temperature of the electromagnetic induction heating cooker and an overheated state of the object in response to the output signals from said temperature sense processing means and power block processing means.

5. A circuit for preventing overheating of an electromagnetic induction heating cooker as set forth in claim 1, further comprising:

fan motor driving means responsive to the cooling fan drive signal from said control means, for driving a cooling fan motor to cool the electromagnetic induction heating cooker.

6. A circuit for preventing overheating of an electromagnetic induction heating cooker as set forth in claim 1, further comprising:

buzzer driving means responsive to the buzzer drive signal from said control means, for driving a buzzer to inform the user of the overheated state of the electromagnetic induction heating cooker.

7. A circuit for preventing overheating of the electromagnetic induction heating cooker, comprising:

temperature sense processing means for sensing the temperature of an object placed on said cooker and outputting a signal indicative thereof;

power block processing means for blocking a power supply to said high-frequency power generation means when an internal temperature of the electromagnetic induction heating cooker exceeds a predetermined reference value, and outputting a signal as a result of the blocking; and control means for discriminating an overheated state of the electromagnetic induction heating cooker in response to the output signals from said temperature sense processing means and power block processing means and controlling an operation of said high-frequency power generation means in accordance with the discriminated state.

8. A circuit for preventing overheating of an electromagnetic induction heating cooker as set forth in claim 7, wherein said temperature sense processing means includes:

a temperature sensor having a resistance varied with the temperature of the object;

comparison means for comparing a voltage level varied by said temperature sensor with a reference voltage level; and switching means being turned on/off in response to an output signal from said comparison means.

9. A circuit for preventing overheating of an electromagnetic induction heating cooker as set forth in claim 7; wherein said power block processing means includes:

a thermal fuse being opened when the internal temperature of the electromagnetic induction heating cooker exceeds the predetermined reference value; and switching means being turned on/off in response to closed/opened states of said thermal fuse.

10. A circuit for preventing overheating of an electromagnetic induction heating cooker as set forth in claim 7, wherein said control means discriminates the internal temperature of the electromagnetic induction heating cooker and an overheated state of the object in response to the output signals from said temperature sense processing means and power block processing means.

11. A circuit for preventing overheating of an electromagnetic induction heating cooker as set forth in claim 7, wherein said control means outputs the cooling fan drive signal to cool the electromagnetic induction heating cooker in accordance with the discriminated overheated state.

12. A circuit for preventing overheating of an electromagnetic induction heating cooker as set forth in claim 11, further comprising:

fan motor driving means responsive to the cooling fan drive signal from said control means, for driving a cooling fan motor to cool the electromagnetic induction heating cooker.

13. A circuit for preventing overheating of an electromagnetic induction heating cooker as set forth in claim 7, wherein said control means outputs a buzzer drive signal to inform the user of the overheated state of the electromagnetic induction heating cooker in accordance with the discriminated overheated state.

14. A circuit for preventing overheating of an electromagnetic induction heating cooker as set forth in claim 13, further comprising:

buzzer driving means responsive to the buzzer drive signal from said control means, for driving a buzzer to inform the user of the overheated state of the electromagnetic induction heating cooker.

* * * * *